US005916105A

United States Patent [19]

Gow

[11] Patent Number: 5,916,105

[45] Date of Patent: Jun. 29, 1999

[54] BAMBOO ROD PANEL

[76] Inventor: Robert H. Gow, 4707 Pin Oak Park #544, Houston, Tex. 77081-2251

[21] Appl. No.: 08/932,672

[22] Filed: Sep. 18, 1997

[51] Int. Cl.[6] ..... E04C 2/40; E04C 2/26; E04H 17/16

[52] U.S. Cl. ..... 52/799.13; 52/764; 52/745.19; 256/19; 256/73

[58] Field of Search ..... 52/799.13, 799.12, 52/799.11, 745.19, 764; 256/19, 73

[56] References Cited

U.S. PATENT DOCUMENTS

| | | | |
|---|---|---|---|
| 2,955,791 | 10/1960 | George . | |
| 3,207,096 | 9/1965 | Munroe . | |
| 3,645,550 | 2/1972 | Biehl . | |
| 4,144,685 | 3/1979 | Fox | 52/223.6 |
| 4,184,435 | 1/1980 | Shevcenko . | |
| 4,384,531 | 5/1983 | Spurgeon . | |
| 4,608,798 | 9/1986 | Spiers | 52/799.13 X |
| 4,714,026 | 12/1987 | Yamaguchi et al. . | |
| 5,067,418 | 11/1991 | Carter . | |
| 5,275,454 | 1/1994 | Deardorff . | |
| 5,485,794 | 1/1996 | Sing . | |
| 5,636,577 | 6/1997 | Gow . | |

OTHER PUBLICATIONS

Gnanaharan, et al., "Bending Strength of Guadua Bamboo," 2 Inbar Working Paper No. 3, KFRI and IDRC, New Delhi, India, 1994.

*Primary Examiner*—Christopher Kent
*Attorney, Agent, or Firm*—Baker & Botts, L.L.P.

[57] ABSTRACT

Bamboo panels and method for forming from bamboo culms and rods are provided. Curved culms from clump bamboo having holes in a selected plane are placed on rods having diameters slightly smaller than the holes, such that forces on the tough skin of bamboo culms are used to hold the culms in a straight or other selected configuration. The panels may be used in fences, furniture, walls and other structures.

21 Claims, 3 Drawing Sheets

BAMBOO ROD PANEL

FIELD OF THE INVENTION

This invention relates to bamboo structures and their use for fencing, furniture, panelling, walls and various improvements thereof.

BACKGROUND OF THE INVENTION

Clumping bamboo can be widely grown in tropical areas of the world. The structure of such bamboo is strikingly different from that of many other plants. The trunk of the plant is called the "culm." "Nodes" exist at various distances along the culm. In some varieties of bamboo, the culm may grow to be several tens of feet in length. The diameter of the culm decreases from a maximum diameter at the earth to a small diameter at the tip. The larger diameter portions of a culm may find many applications, such as described in my U.S. Pat. No. 5,675,951 and U.S. Pat. No. 5,636,577. The smaller segments of large culms or smaller diameter culms, however, require other applications taking advantage of the unique structural characteristics of bamboo. Among these characteristics is a tough, hard outer skin.

Bamboo culms having a diameter from about 0.5 inches to about 1.5 inches are strong, flexible and elastic. When flexed, the culm bends and will not break as easily as wood. When flexed for a short period of time, it will return to its original configuration. Bamboo is also easily treatable with chemicals. Treatment methods can be used on bamboo which make it easier to treat than wood, because the fibers in bamboo run in the same direction. For example, a treatment method for bamboo is the Boucherie/Sap Displacement Method. A disadvantage of bamboo in many applications is the growth habit of the plant. Immature culms from clumping bamboo often grow in arcs, because the culms not in the center of a clump grow outwardly to receive more sunlight. Particularly the Dendrocalamus Strictus and the Jimba varieties grow in a curve; however, the curvature is generally in one plane.

If the clumps in which tropical bamboo grows are placed optimal distances apart, straight culms are expected when clumps grow large and the culms are 40 to 60 feet tall. Such culms will be several inches in diameter at the bottom. During immaturity, however, the clumps are smaller and the diameter of the culms is much smaller. Therefore, culms in the size range of about 0.5 to about 1.5 inches can be obtained either from young bamboo or from the upper reaches of mature bamboo culms. The immature culms, particularly, are likely to be curved.

Once established, bamboo replenishes itself very rapidly. Therefore, fully developed bamboo culms can be cut every two to three years. In even less time, culms in the 0.5 to 1.5 inch diameter can be cut from immature clumps. One-half to one-third of the immature culms can be cut each year. This thinning of a clump of bamboo causes larger culms to develop. Therefore, in the process of growing large culms for other applications, a supply of culms in the 0.5 to 1.5 inch diameter is available. There is need for methods and products to utilize this bamboo and to take advantage of its unique properties.

SUMMARY OF THE INVENTION

A method is provided for forming panels from bamboo culms, including culms which are curved. Culms are cut into a preferred length. If the culm is curved, a first hole is formed in the plane of curvature of the culm. Forming of the hole is preferably from the concave side of the curvature for about half the curved culms and from the convex side of the curvature for the remaining half of the curved culms. One or more additional holes are drilled in the same direction and parallel to the first hole and at a selected distance removed along the length of the culm. The diameter of the hole is selected according to the diameter of the culm and the desired strength of the panel, but preferably is about from 0.125-inch to about 0.75-inch in diameter. The distances from one end of the bamboo culm, measured when the culm is straightened, to all holes in the culm are preferably made equal for a plurality of culms. Rods having a selected diameter, preferably only slightly smaller than the holes, are then placed through the holes in the culms. Preferably, when culms are curved the culms are placed with alternate curvatures left and right when placed on the rods. A washer may be placed between each culm placed on a rod. Variations in the diameters of the culms along their length are also preferably taken into account in selecting the direction in which each culm is placed on the rods. A retainer may be placed on the end of each rod to form a panel having bamboo culms kept in approximately parallel position by a plurality of rods. The panel so formed may be any selected width depending on the number of culms placed on the rods. A combination of straight and curved culms may be used in a panel. In another embodiment, culms are spaced apart such that other materials may be placed between the culms and the culms are held in place by frictional force between the hole surfaces of the culms and the rods. In yet another embodiment, the bamboo culms are not placed on rods, but culms having holes drilled in the preferred locations are supplied with rods in the form of a kit which may be formed into a panel. The panels of this invention, which can be strong yet flexible, and very inexpensive, can provide advantageous improvements in the construction of fencing, panelling, flooring, walls, furniture and other structures.

DETAILED DESCRIPTION OF PREFERRED EMBODIMENT

Figure 1:
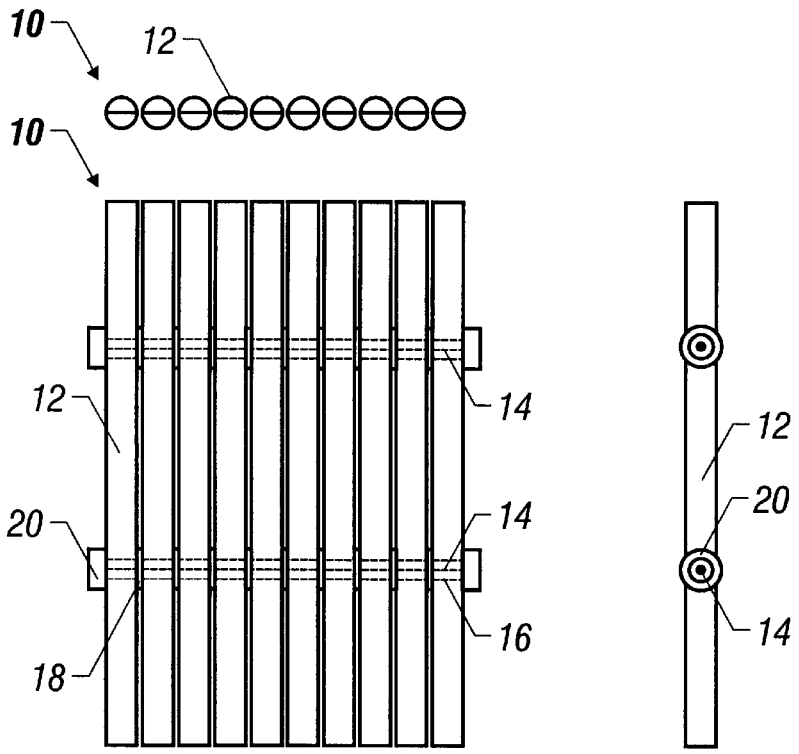
FIG. 1 is a view of a panel constructed in accordance with the teachings of this invention as seen from the top, front and end thereof.

FIG. 1 illustrates top, front and side views of panel 10 having bamboo culms 12 held in place by rods 14 placed through holes 16 in each bamboo culm 12. Rods 14 may be made of steel, brass or other metal, of wood or plastic or any material having a smooth surface and sufficient stiffness or resistance to bending for passing through holes 16 and maintaining holes 16 in a fixed position. Washers 18 may or may not be placed between each pair of culms. Retainers 20 are shown placed on the end of rods 14 to prevent the culms being removed from the rods. Retainers may be nuts held in place by threads on rods 14, bent sections of rod 14 or any of a large variety of push-on or pinned retainers. The culms of this invention are often immature culms cut from clumps of bamboo or culms from the tops of mature culms, having a diameter in the range of 0.5 to 1.5 inches, but any sizes of culms may be used in which holes can be formed and rods placed through the holes.

Figure 2:
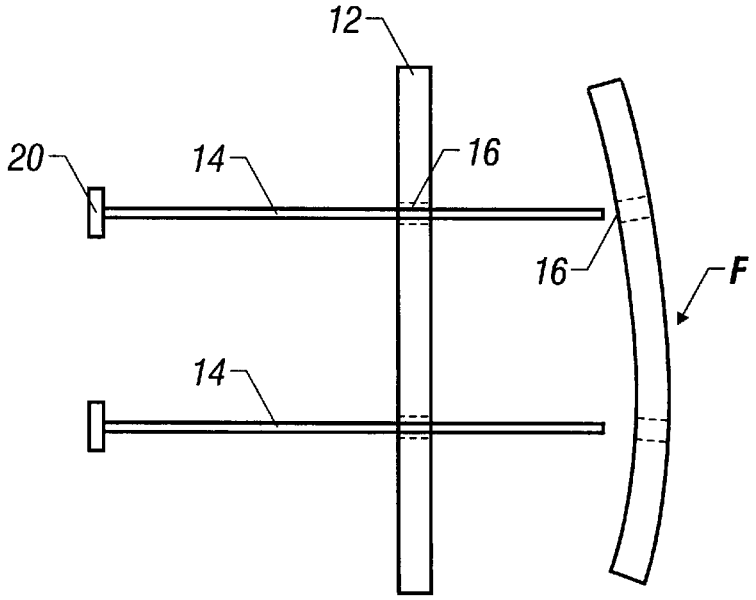
FIG. 2 is a sketch of a procedure for placing curved bamboo culms on rods according to a preferred embodiment of this invention.

FIG. 2 shows curved bamboo culms 12 having been drilled with a plurality of holes 16, each hole being approximately in the plane of curvature of the culm. Fasteners 20 may be placed on the end of rods 14, but fasteners may not be required in some applications. Sufficient force F is applied during placing of the bamboo culms on rods 14 to force each curved bamboo culm into an approximate straight configuration. Such force may be applied by a point force near each end or in the center of a culm, depending on the direction of curvature. The sizes of rods 14 and holes 16 are selected such that the culm must be approximately straight before rod 14 will enter the holes. Rod 14 preferably has stiffness sufficient to maintain the rod straight from its point of support, which in FIG. 2 is shown to be a second culm already placed on the rods, to holes 16 in the culm to be placed on the rods. Other points of support of rods 14 may be used, such as clamps placed around rods 14 during assembly of a panel (not shown). Rod 14 preferably also has a stiffness sufficient to overcome the bending force present in the bamboo culm being added to rods 14 after the culm has been straightened and placed on rods 14. This force is exerted by the walls of holes 16 in contact with rods 14. The differences in diameters of holes 16 and rods 14 should be in the range from about 0.005 inch to about 0.1 inch, depending on the sizes of the rods and culms. This difference in size should be great enough to allow the culms to be forced onto the rods by a bending force and small enough to hold the culms in an almost straight position from the torque exerted by the walls of the holes, especially where the rods contact the tough skin of the bamboo.

Curved culms are preferably placed such that adjacent culms have initial curvatures in opposite directions, but this is not required. One reason for alternating direction of curvature is that a less stiff or smaller rod is required using this procedure, which decreases the cost of the rods. After all culms are placed on the rods to the selected width of the panel, an additional retainer such as 20 may placed on the opposite end of each rod. Frictional force preventing movement of culms 12 along rods 14 may be sufficient such that retainers 20 are not necessary for some applications.

It has been found that culms 12 are more easily placed or moved along rods 14 if the direction of drilling of holes 16 is the same direction in which the culm is to be moved along rods 14, when the holes are drilled mechanically. This is caused by the structure of the tough skin of a bamboo culm, which tends to break into filaments when penetrated from inside by a drill bit. Therefore, it is preferable to drill half the mechanically drilled curved culms from the convex side of the plane of curvature and half the curved culms from the concave side. Alternatively, holes may be formed by laser, by hydraulic jet or other means.

Heretofore, panels have been described having culms held in place approximately perpendicular to the rods. However, culms may be placed such that the culms have a selected radius of curvature between rods 14. This may be accomplished by drilling holes 16 in the plane of curvature of curved culms or any plane in straight culms but drilling the holes at a selected angle with respect to perpendicular to the longitudinal axis through the culms. Thus the tough outer skin of the bamboo contacts the rods to hold the axis of a culm at a selected angle with respect to the rod.

Figure 3:
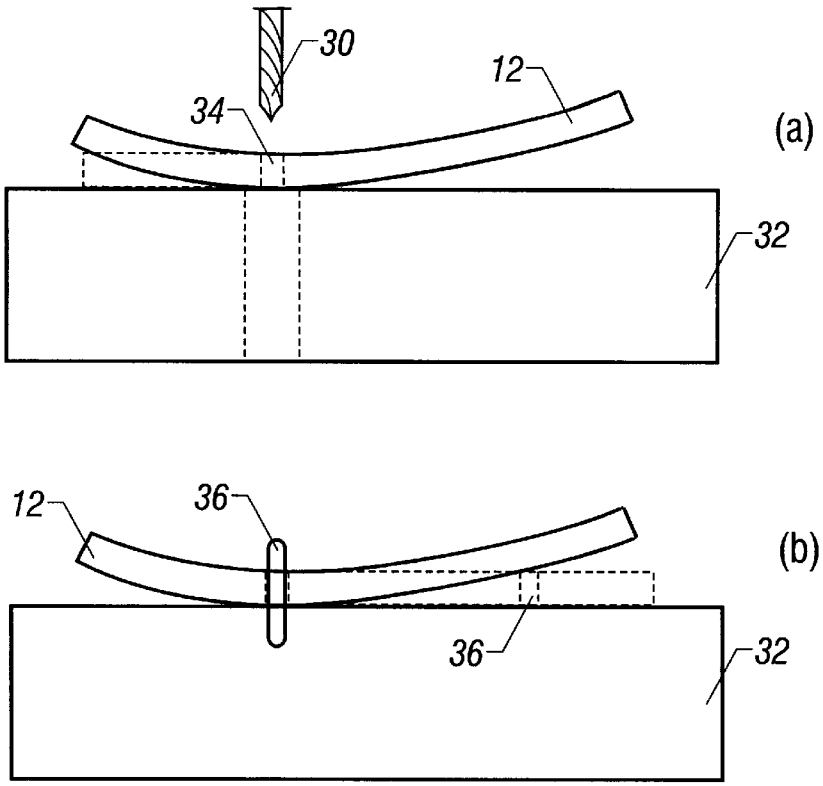
FIG. 3 is a sketch of a procedure for forming holes in curved bamboo culms according to a preferred embodiment of this invention.

FIG. 3 illustrates how holes of selected diameter may be mechanically drilled from the concave side in each curved culm. The plane of curvature of culm 12 is placed approximately in the direction of drill bit 30 and the culm is supported by base 32. A plurality of drills may be used to simultaneously form holes in a culm or, alternatively, a single hole 34 may first be drilled as shown in FIG. 3(*a*). Culm 12 is then moved and placed on pin 36, as shown in FIG. 3(*b*), and drill 30 is placed to form second hole 36 in culm 12. This procedure may be repeated to form the requisite number of holes along the length of culm 12. If a plurality of holes are drilled simultaneously by spaced apart drills such as 30, culm 12 is straightened by application of force, if necessary, before the holes are drilled. To measure the correct position of a hole along a culm, the culm is preferably forced against base 32. When holes are to be drilled from the convex side in the plane of curvature, a culm may be conveniently placed over a small support area under the drill bit where the first hole is to be drilled.

Figure 4:
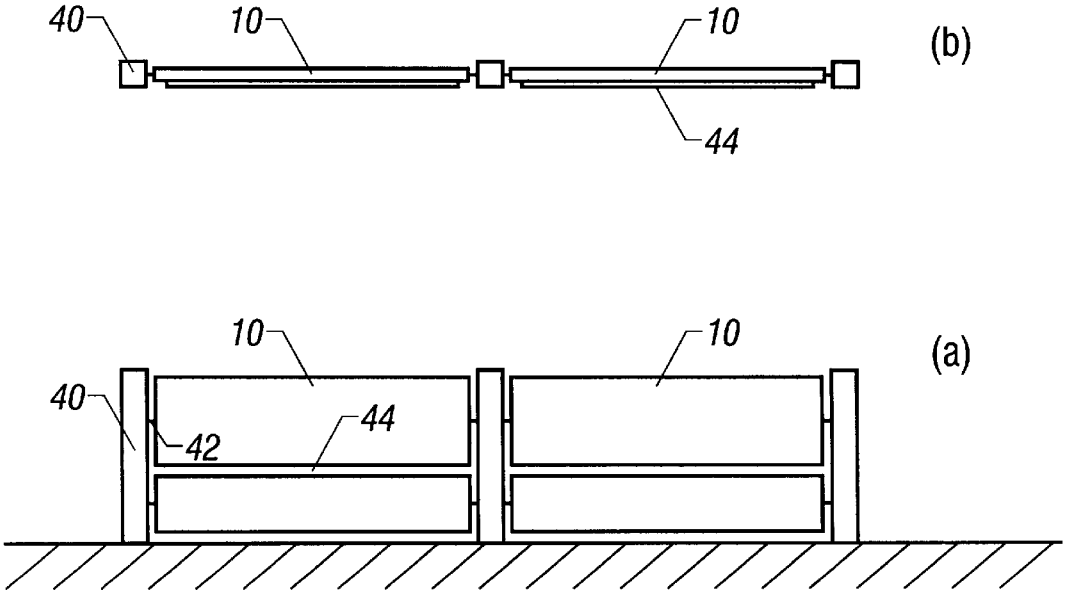
FIG. 4 is a view of a fence constructed according to a preferred embodiment and incorporating panels of this invention.

A panel of this invention such as shown in FIG. 1 may be employed by joining panels to form a structure such as a fence, as illustrated in FIG. 4. Posts 40 are adapted to receive fasteners 42, placed at the end of each panel 10. Fasteners 42 may be any of a wide variety of fasteners, such as a pin through eyes (as in a common hinge, for example), or a nail or screw.

A panel suitable for a fence may be stabilized to prevent movement perpendicular to the flat surface of the panel by placing rail 44 along the length of the panel. Rail 44 is preferably half or whole bamboo culm. Such rail may be fastened to the vertical culms by nails, screws, or other fasteners.

Figure 5:
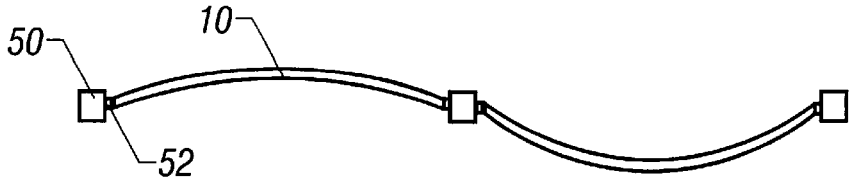
FIG. 5 is a view of a fence constructed from curved panels.

In another embodiment, rails are not applied to the panels and a fence is formed having a curved configuration such as shown in FIG. 5, which has panel 10 connected to posts 50 by connectors 52. Such fence configurations are particularly suitable for decorative purposes, and also for improving the stability of a fence. Alternatively, multiple arcs (not shown) may be placed between successive posts 50. Alternatively, the panel of FIG. 1 may be turned 90 degrees such that bamboo culms 12 are placed in a horizontal position and rods 14 are placed in a vertical position to form a panel for a fence (not shown). When the culms are in a horizontal position, thinner or fewer rods may be used and the need for support perpendicular to the culms is reduced, since the tendency of the fence to sag or to move in the plane of the panel is reduced. The rods are of selected diameters depending on the size of the culms, but are usually from about 0.125-inch to about 0.75-inch in diameter.

A panel suitable to form a fence was made from culms having a length of 8 feet. The panel was formed from 67 culms of bamboo. The weight of the panel was 160 lbs. The diameter of the steel rods used was 0.25 inch. The culms were about 0.5 to about 1.5-inch in diameter.

Alternatively, bamboo culms may be placed at selected spaced-apart locations on the rods and held in place by frictional force exerted by the surfaces of holes in the bamboo. If the culms are initially curved and a force, F, is exerted to place a culm on the rods, as shown in FIG. 2, the culms will remain at the selected spaced-apart locations and other materials such as sheets of plastic, parts of a bamboo plant, wood or metal or mixtures thereof may be fastened in place between the bamboo culms. If the culms are initially straight, holes such as holes 16 in FIG. 2 may be formed at an angle other than perpendicular to the axis of the culms but near enough to perpendicular such that the culms can be placed on the rods and not be significantly curved. This will allow frictional force to hold the culms in place at desired locations, such as spaced-apart, while other materials may be placed between the culms.

Figure 6:
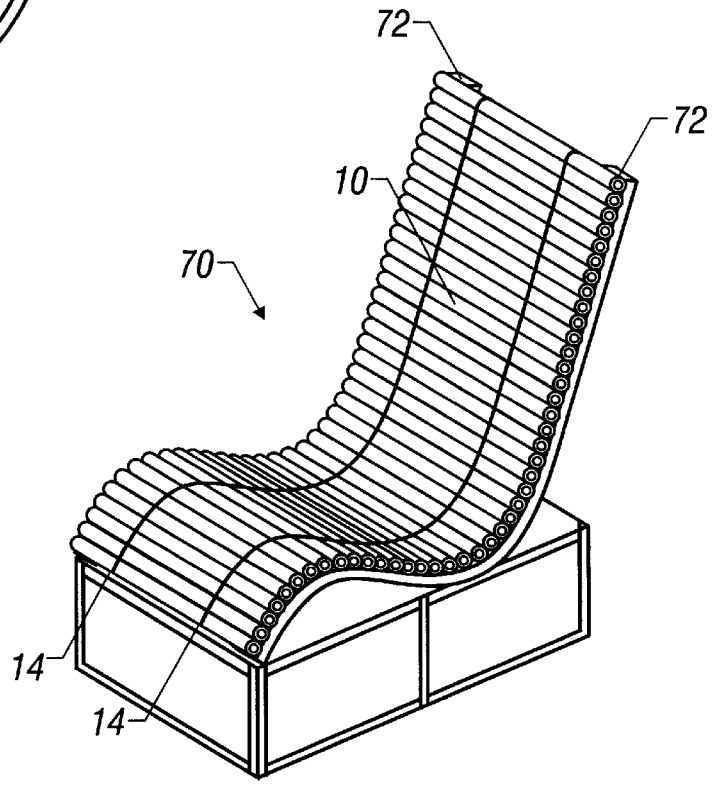
FIG. 6 is a view of a piece of furniture incorporating panels of this invention.

The panels of this invention may also be used to form furniture. Referring to FIG. 6, panel 10 is first formed using rods 14 which are sufficiently stiff to allow placing culms in place as described above but which are sufficiently deformable to be formed into curved shapes. Rigid rod 72 has been formed into the desired shape of a chair or lounger, 70. Panel 10 of this invention is placed over the contour of rod 72 to form a surface of a seat or couch. Panel 10 may be attached to rigid rods 72 by clamps (not shown) or may rest on the rigid structure. Rods 72 may be formed of metal such as steel or aluminum or may be formed of a larger bamboo, rattan or other wooden materials. The culms in panel 10 may be sanded or sawed so as form a flatter seating surface.

Figure 7:
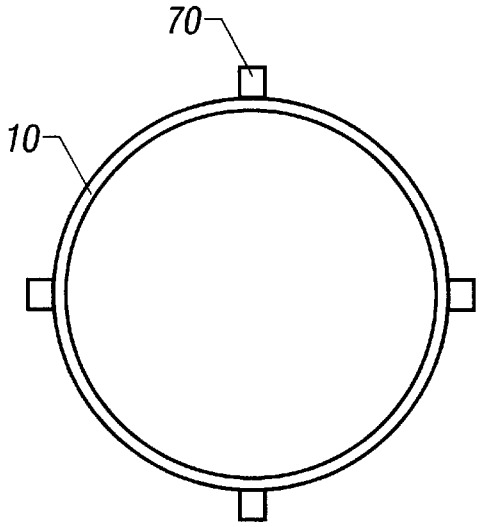
FIG. 7 is a top view of walls of a structure constructed according to a preferred embodiment and incorporating panels of this invention.

One of the significant advantages of the panel of this invention is its ability to be formed into curved structures. A circle may be formed from the panels, as shown in FIG. 7, or rectangular-shaped or other shapes may be used. The structure, similar to a bamboo fence in the form of a circle or rectangle, can serve as a wall of a building. A roof may then be placed over the wall, the roof may also having been formed of bamboo or other roofing materials. The panels of this invention may be used to form the roof. Waterproof materials may then be placed over the panels. Posts 70 may be used to anchor the structure.

The panels described herein may be joined or attached by nailing, at least if the bamboo is D. Strictus. The nails may be pointed or flat at the entry end and may be used just as nails are used with wood. Surprisingly, it has been found that bamboo culms of this variety may be nailed, which is contrary to prior literature on bamboo. Therefore, the panels such as shown in FIG. 1 may be nailed to posts, other bamboo panels and other members of structures. Alternatively, the panels may be attached by hooks, wires or other fasteners.

The invention has been described with respect to its preferred embodiments. Those of ordinary skill in the art may, upon reading this disclosure, appreciate changes or modifications which do not depart from the scope and spirit of the invention as described above or claimed hereafter.

What is claimed is:

1. A method for forming panels of bamboo, comprising the steps of:

forming a selected number of segments of bamboo culms, the segments having a longitudinal axis and a selected length;

forming at least two holes of a selected size in the segments of bamboo culms, the holes being formed at a selected angle with respect to the longitudinal axis and in a selected plane approximately passing through the longitudinal axis of the culms; and passing rods through the holes in the culms.

2. The method of claim 1 wherein at least a fraction of the selected number of segments of bamboo culms are initially curved, the selected angle is approximately 90 degrees and the selected plane for the initially curved segments is the plane of curvature of the bamboo culms, so as to hold the culms in a straight configuration.

3. The method of claim 1 wherein the selected size of the holes and the selected angle are such that when culms are placed on the rods the culms are held in a selected radius of curvature in the plane of the rods.

4. The method of claim 1 wherein the selected size of the holes formed in bamboo culms and the selected angle are such that the culms placed on rods are held in position on the rods by frictional force between the surface of the holes and the rods.

5. The method of claim 1 wherein the holes are formed by mechanical drilling.

6. The method of claim 1 wherein the culms are placed at selected spaced-apart locations on the rods.

7. The method of claim 1 wherein the culms are placed on the rods in directions of increasing and decreasing diameters such as to minimize gaps between adjacent culms.

8. The method of claim 1 additionally comprising the step of placing retainers on the rods.

9. The method of claim 1 wherein the diameter of the culms is in the range from about 0.5 inch to about 1.5 inch.

10. The method of claim 1 wherein the rods are made of metal.

11. A bamboo panel, comprising:

a selected number of segments of bamboo culms, the segments having a longitudinal axis and holes at a selected angle with respect to the longitudinal axis, the holes being in a selected plane approximately passing through the longitudinal axis; and rods passing through the holes.

12. The panel of claim 11 wherein the selected angle is approximately 90 degrees and the holes are sized so as to hold the culms in a straight configuration.

13. The panel of claim 11 wherein the culms are at spaced-apart locations on the rods.

14. The panel of claim 11 additionally comprising retainers on the rods.

15. The panel of claim 11 wherein the culms are from abut 0.5 to about 1.5 inch in diameter.

16. The panel of claim 11 wherein the rods are metal.

17. A fence, comprising:

a plurality of bamboo panels, the panels having a selected number of segments of bamboo culms, the segments having a longitudinal axis and holes at a selected angle with respect to the longitudinal axis, the holes being in a selected plane approximately passing through the longitudinal axis and rods passing through the holes;

posts; and means for fastening the panels to the posts.

18. The fence of claim 17 wherein the rods are curved.

19. The fence of claim 17 additionally comprising a rail on the panels so as to prevent movement perpendicular to the selected plane.

20. A wall, comprising:

a plurality of bamboo panels, the panels having a selected number of segments of bamboo culms, the segments having a longitudinal axis and holes at a selected angle with respect to the longitudinal axis, the holes being in a selected plane approximately passing through the longitudinal axis and rods passing through the holes; and means for supporting the panels.

21. A kit to form a bamboo panel, comprising:

a selected number of segments of bamboo culms, the segments having a longitudinal axis and holes at a selected angle with respect to the longitudinal axis, the holes being in a selected plane approximately passing through the longitudinal axis, the holes being formed at equidistance from the end of the segments of culms; and rods adapted for placing through the holes.

* * * * *